US011260662B2

(12) United States Patent
Wanikawa

(10) Patent No.: US 11,260,662 B2
(45) Date of Patent: Mar. 1, 2022

(54) LIQUID DISCHARGE HEAD AND LIQUID DISCHARGE APPARATUS

(71) Applicant: SEIKO EPSON CORPORATION, Tokyo (JP)

(72) Inventor: Kunio Wanikawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/943,033

(22) Filed: Jul. 30, 2020

(65) Prior Publication Data

US 2021/0031519 A1 Feb. 4, 2021

(30) Foreign Application Priority Data

Jul. 30, 2019 (JP) ..... JP2019-139490

(51) Int. Cl.
*B41J 2/14* (2006.01)

(52) U.S. Cl.
CPC .. *B41J 2/14233* (2013.01); *B41J 2002/14241* (2013.01); *B41J 2002/14491* (2013.01)

(58) Field of Classification Search
None
See application file for complete search history.

(56) References Cited

U.S. PATENT DOCUMENTS

2005/0046678 A1 3/2005 Owaki et al.
2018/0154652 A1* 6/2018 Yazaki ..... B41J 2/055

FOREIGN PATENT DOCUMENTS

JP 2009-202599 A 9/2009

* cited by examiner

*Primary Examiner* — Erica S Lin
(74) *Attorney, Agent, or Firm* — Workman Nydegger

(57) ABSTRACT

A liquid discharge head includes a pressure chamber substrate provided with a plurality of pressure chambers, a piezoelectric element row in which a plurality of piezoelectric elements that are provided to correspond to the plurality of pressure chambers respectively and that generate a pressure for discharging a liquid are arranged in a predetermined direction, and a protection portion positioned opposite to the plurality of pressure chambers with respect to the piezoelectric element row, and forming a space common to the plurality of piezoelectric elements, in which in regard to a first portion of the protection portion and a second portion of the protection portion having a position different from the first portion in the predetermined direction, a rigidity of the first portion is higher than a rigidity of the second portion.

13 Claims, 14 Drawing Sheets

LIQUID DISCHARGE HEAD AND LIQUID DISCHARGE APPARATUS

The present application is based on, and claims priority from JP Application Serial Number 2019-139490, filed Jul. 30, 2019, the disclosure of which is hereby incorporated by reference herein its entirety.

BACKGROUND

1. Technical Field

The present disclosure relates to a liquid discharge head and a liquid discharge apparatus.

2. Related Art

A technology is proposed in related art, in which a vibration plate constituting a wall surface of a pressure chamber is vibrated by a piezoelectric element to discharge a liquid such as an ink filled in the pressure chamber from a nozzle. A liquid discharge head described in JP-A-2009-202599 includes a flow path substrate, a vibration plate formed on the flow path substrate, a piezoelectric element row in which a plurality of piezoelectric elements formed on the vibration plate are arranged, and a sealing substrate that secures a space that does not hinder the movement of the piezoelectric element.

The sealing substrate described in JP-A-2009-202599 is provided such that a thickness of the sealing substrate positioned above a plurality of piezoelectric elements constituting one piezoelectric element row is constant in an arrangement direction of the plurality of piezoelectric elements, and the plurality of piezoelectric elements are covered. In JP-A-2009-202599, by increasing the rigidity of the sealing substrate, the rigidity of the flow path substrate bonded to the sealing substrate is improved. However, when the plurality of piezoelectric elements are covered by the sealing substrate having such a configuration, there is a possibility that a resonance frequency may deviate from a desired frequency. As a result, there is a possibility that discharge performance such as a discharge amount and a discharge speed is reduced.

SUMMARY

According to an aspect of the present disclosure, a liquid discharge head includes a pressure chamber substrate provided with a plurality of pressure chambers, a piezoelectric element row in which a plurality of piezoelectric elements that are provided to correspond to the plurality of pressure chambers respectively and that generate a pressure for discharging a liquid are arranged in a predetermined direction, and a protection portion positioned opposite to the plurality of pressure chambers with respect to the piezoelectric element row, and forming a space common to the plurality of piezoelectric elements, in which in regard to a first portion of the protection portion and a second portion of the protection portion having a position different from the first portion in the predetermined direction, a rigidity of the first portion is higher than a rigidity of the second portion.

According to an aspect of the present disclosure, a liquid discharge head includes a pressure chamber substrate provided with a plurality of pressure chambers, a piezoelectric element row in which a plurality of piezoelectric elements that are provided to correspond to the plurality of pressure chambers respectively and that generate a pressure for discharging a liquid are arranged in a predetermined direction, and a protection portion positioned opposite to the plurality of pressure chambers with respect to the piezoelectric element row, and forming a space common to the plurality of piezoelectric elements, in which a through hole communicating with the space is provided in the protection portion.

According to an aspect of the present disclosure, a liquid discharge head includes a pressure chamber substrate provided with a plurality of pressure chambers, a piezoelectric element row in which a plurality of piezoelectric elements that are provided to correspond to the plurality of pressure chambers respectively and that generate a pressure for discharging a liquid are arranged in a predetermined direction, and a protection portion positioned opposite to the plurality of pressure chambers with respect to the piezoelectric element row, and forming a space common to the plurality of piezoelectric elements, in which the protection portion is provided with a groove in a portion on a side of the plurality of pressure chambers.

According to an aspect of the present disclosure, a liquid discharge head includes a pressure chamber substrate provided with a plurality of pressure chambers, a piezoelectric element row in which a plurality of piezoelectric elements that are provided to correspond to the plurality of pressure chambers respectively and that generate a pressure for discharging a liquid are arranged in a predetermined direction, and a protection portion positioned opposite to the plurality of pressure chambers with respect to the piezoelectric element row, and forming a space common to the plurality of piezoelectric elements, in which in regard to a first portion of the protection portion and a second portion of the protection portion having a position different from the first portion in the predetermined direction, a thickness of the first portion is thicker than a thickness of the second portion.

According to an aspect of the present disclosure, a liquid discharge head includes a pressure chamber substrate provided with a plurality of pressure chambers, a piezoelectric element row in which a plurality of piezoelectric elements that are provided to correspond to the plurality of pressure chambers respectively and that generate a pressure for discharging a liquid are arranged in a predetermined direction, and a protection portion disposed above the pressure chamber substrate and having a wall shape along a thickness direction of the pressure chamber substrate.

According to an aspect of the present disclosure, a liquid discharge head includes a nozzle plate provided with a first nozzle and a second nozzle, a pressure chamber substrate provided with a first pressure chamber communicating with the first nozzle and a second pressure chamber communicating with the second nozzle, an actuator having a vibration plate disposed opposite to the nozzle plate with respect to the pressure chamber substrate, a first piezoelectric element provided in the vibration plate to correspond to the first pressure chamber, and a second piezoelectric element provided in the vibration plate to correspond to the second pressure chamber, and a protection portion that is in contact with the actuator and that forms a space common to the first piezoelectric element and the second piezoelectric element, in which the protection portion has a first portion and a second portion having a higher rigidity than a rigidity of the first portion and aligned with the first portion in a direction in which the first piezoelectric element and the second piezoelectric element are aligned.

DESCRIPTION OF EXEMPLARY EMBODIMENTS

1. First Embodiment

1-1. Overall Configuration of Liquid Discharge Apparatus 100

Figure 1:
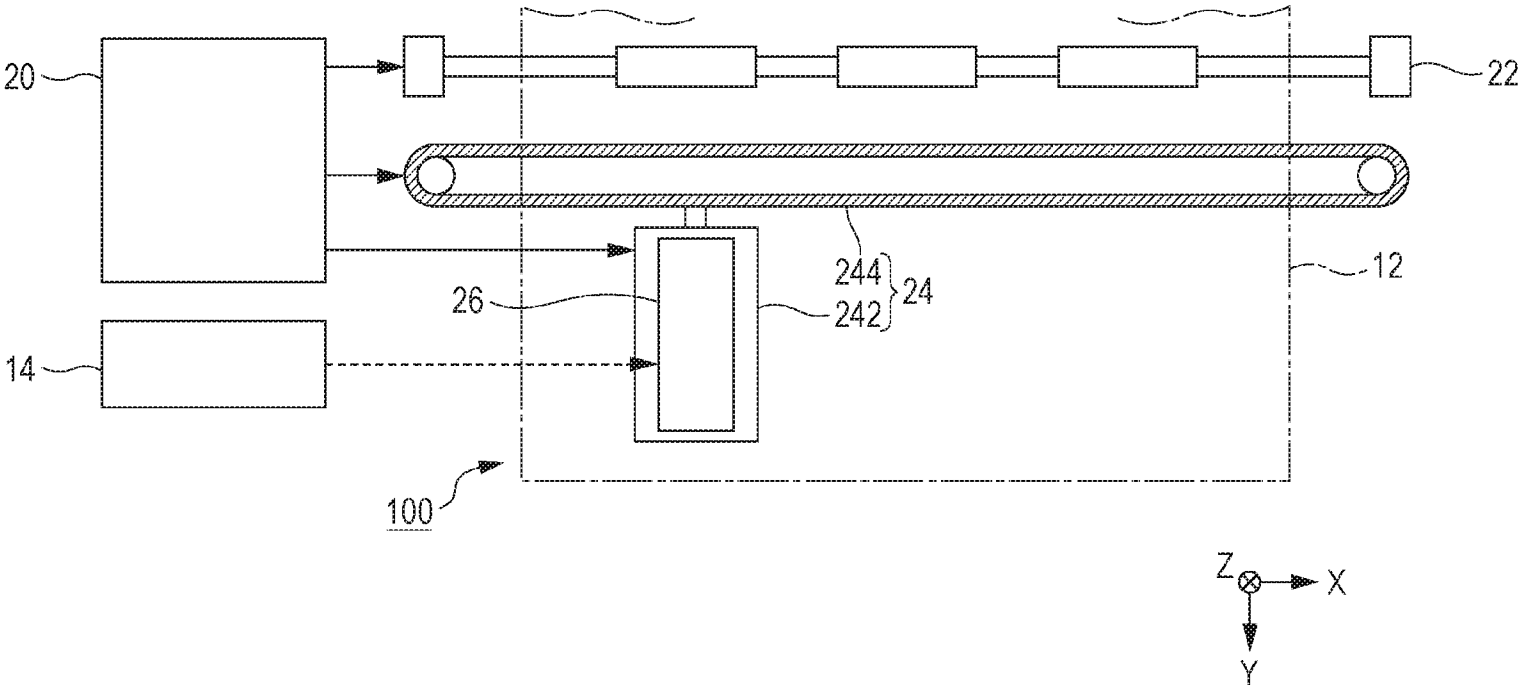
FIG. 1 is a block diagram illustrating a configuration of a liquid discharge apparatus according to a first embodiment.

FIG. 1 is a configuration diagram illustrating the liquid discharge apparatus 100 according to a first embodiment. In the following, for convenience of description, the description will be made by appropriately using an X-axis, a Y-axis, and a Z-axis. The X, Y, and Z axes are orthogonal to each other. A −Z direction is defined as "up" and the +Z direction is defined as "down". Further, in the present disclosure, the expression "an element B is disposed above an element A" is not limited to a configuration in which the element A and the element B are in direct contact. A configuration in which the element A and the element B are not in direct contact with each other is also included in the concept of "an element B is disposed above an element A".

The liquid discharge apparatus 100 of the first embodiment is a printing apparatus of an ink jet method that discharges an ink, which is an example of a "liquid", to a medium 12. The medium 12 is typically printing paper, but a printing target of an arbitrary material such as a resin film or cloth is used as the medium 12. As illustrated in FIG. 1, the liquid discharge apparatus 100 is provided with a liquid container 14 reserving an ink. For example, a cartridge detachable from the liquid discharge apparatus 100, a bag-shaped ink pack formed of a flexible film, or an ink tank capable of refilling an ink is used as the liquid container 14.

As illustrated in FIG. 1, the liquid discharge apparatus 100 includes a control unit 20, a transport mechanism 22, a movement mechanism 24, and a liquid discharge head 26. The control unit 20 is an example of a "control portion". The control unit 20 includes, for example, one or a plurality of processing circuits such as a central processing unit (CPU) or a field programmable gate array (FPGA), and one or a plurality of storage circuits such as a semiconductor memory, and controls each element of the liquid discharge apparatus 100 in an integrated manner. For example, the control unit 20 controls an operation of the liquid discharge head 26.

The transport mechanism 22 transports the medium 12 in the +Y direction under the control of the control unit 20. Further, the movement mechanism 24 causes the liquid discharge head 26 to reciprocate along the X-axis under the control of the control unit 20. The X-axis intersects the Y-axis along the direction in which the medium 12 is transported. The movement mechanism 24 of the first embodiment includes a substantially box-shaped transport body 242 that accommodates the liquid discharge head 26, and a transport belt 244 to which the transport body 242 is fixed. A configuration in which a plurality of the liquid discharge heads 26 are mounted on the transport body 242, or a configuration in which the liquid container 14 is mounted on the transport body 242 together with the liquid discharge head 26 can be adopted.

The liquid discharge head 26 discharges the ink supplied from the liquid container 14 from a plurality of nozzles to the medium 12 under the control of the control unit 20. Each liquid discharge head 26 discharges the ink to the medium 12 in parallel with the transport of the medium 12 by the transport mechanism 22 and the repetitive reciprocation of the transport body 242, so that an image is formed on a surface of the medium 12.

1-2. Overall Configuration of Liquid Discharge Head 26

Figure 2:
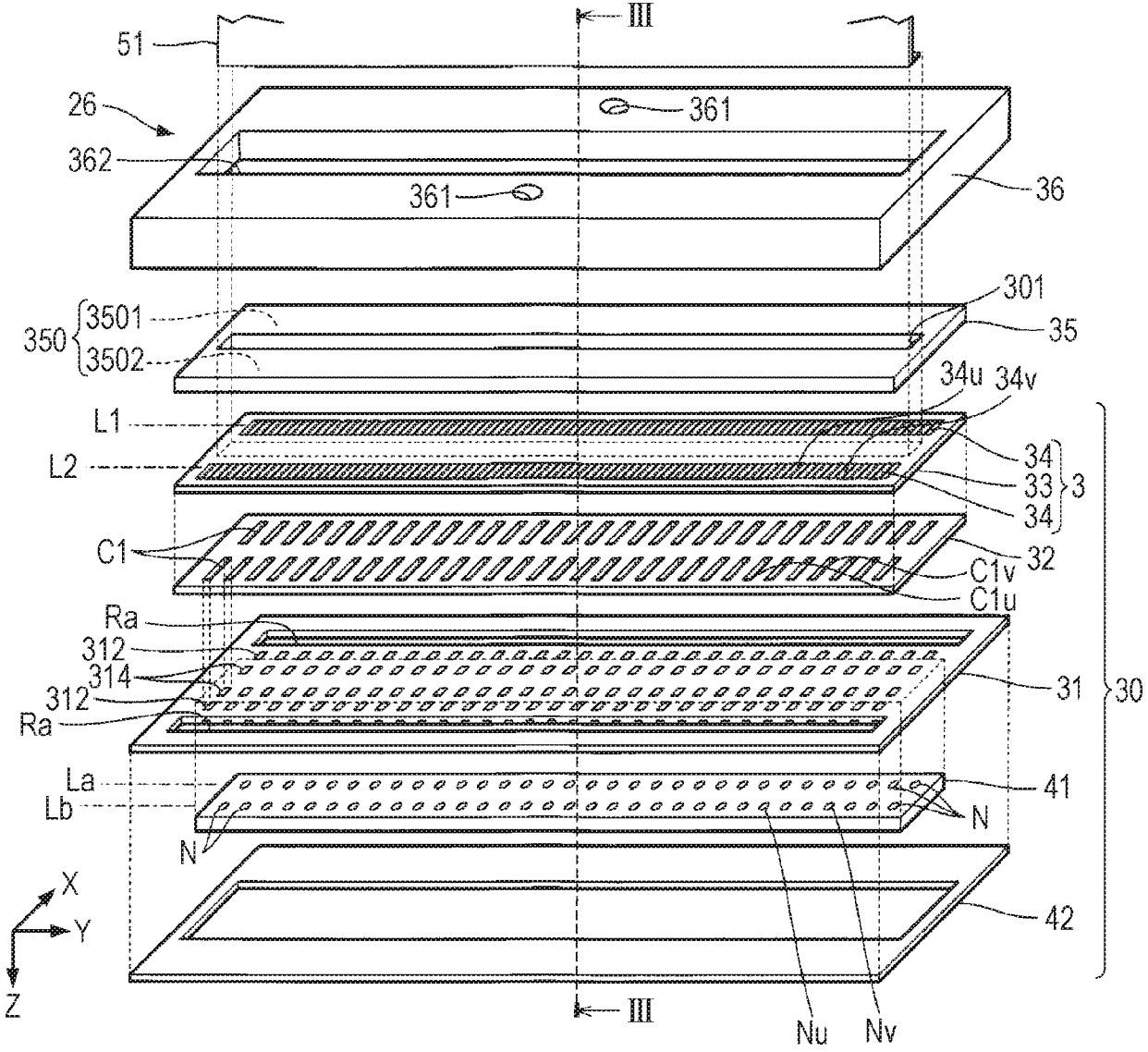
FIG. 2 is an exploded perspective view of a liquid discharge head.
Figure 3:
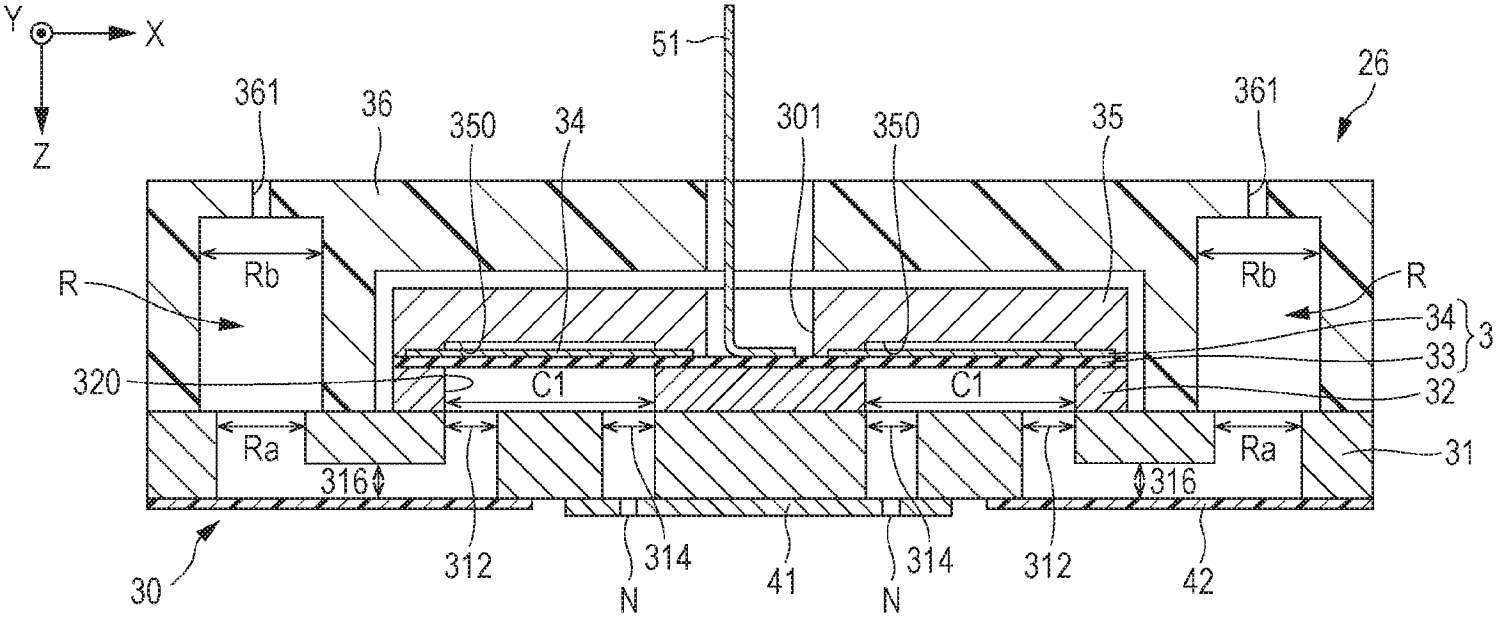
FIG. 3 is a sectional view of the liquid discharge head.

FIG. 2 is an exploded perspective view of the liquid discharge head 26. FIG. 3 is a sectional view taken along a line III-III in FIG. 2. A section illustrated in FIG. 3 is a section parallel to an X-Z plane. The Z-axis is an axis along an ink discharge direction by the liquid discharge head 26.

As illustrated in FIG. 2, the liquid discharge head 26 includes a plurality of nozzles N arranged along the Y-axis. Among the plurality of nozzles N, an arbitrary nozzle N is a first nozzle Nu, and another arbitrary nozzle N aligned with the Y-axis with the nozzle N is a second nozzle Nv. Further, the plurality of nozzles N of the first embodiment are divided into a first nozzle row La and a second nozzle row Lb arranged side by side at an interval from each other along the X-axis. Each of the first nozzle row La and the second nozzle row Lb is a set of the plurality of nozzles N arranged linearly along the Y-axis. The liquid discharge head 26 of the first embodiment has a structure in which an element related to each nozzle N in the first nozzle row La and an element related to each nozzle N in the second nozzle row Lb are disposed substantially in plane symmetry. Accordingly, in the following description, an element corresponding to the first nozzle row La will be mainly described, and the description of an element corresponding to the second nozzle row Lb will be appropriately omitted.

As illustrated in FIGS. 2 and 3, the liquid discharge head 26 includes a flow path structure body 30, a plurality of piezoelectric elements 34, a protection portion 35, a casing portion 36, and a wiring substrate 51. The flow path structure body 30 is a structure in which a flow path for supplying an ink to each of the plurality of nozzles N is formed. The flow path structure body 30 includes a flow path substrate 31, a pressure chamber substrate 32, a vibration plate 33, a nozzle plate 41, and a vibration absorber 42. An actuator 3 is constituted with the vibration plate 33 and the plurality of piezoelectric elements 34. Further, each member constituting the flow path structure body 30 is a long plate-shaped member along the Y-axis. The pressure chamber substrate 32 and the casing portion 36 are provided on the surface of the flow path substrate 31 on a side of the +Z-axis. On the other hand, the nozzle plate 41 and the vibration absorber 42 are provided on the surface of the flow path substrate 31 on a side of the −Z-axis. Each member is fixed by, for example, an adhesive.

The nozzle plate 41 is a plate-shaped member on which the plurality of nozzles N are formed. Each of the plurality of nozzles N is a circular through hole discharging the ink. However, the shape of the nozzle N does not necessarily have to be a perfect circular shape, but may be an elliptical shape or another irregular shape. The nozzle plate 41 is manufactured by, for example, processing a single crystal substrate of silicon (Si) using a semiconductor manufacturing technology such as photolithography and etching. However, a known material and a manufacturing method can be arbitrarily adopted for manufacturing the nozzle plate 41.

As illustrated in FIGS. 2 and 3, a space Ra, a plurality of supply flow paths 312, a plurality of communication flow paths 314, and a relay liquid chamber 316 are formed in the flow path substrate 31. The space Ra is an opening formed in a long shape along the Y-axis. Each of the supply flow path 312 and the communication flow path 314 is a through hole formed for each nozzle N. The relay liquid chamber 316 is a long-shaped space formed along the Y-axis over the plurality of nozzles N, and allows the space Ra and the plurality of supply flow paths 312 to communicate with each other. Each of the plurality of communication flow paths 314 overlaps one nozzle N corresponding to the communication flow path 314 in plan view as viewed from the +Z direction.

As illustrated in FIGS. 2 and 3, a plurality of pressure chambers C1 are provided on the pressure chamber substrate 32. The pressure chamber C1 is a space formed by a wall surface 320 of the pressure chamber substrate 32 and having a long shape along the X-axis in plan view. The pressure chamber C1 is a space positioned between the flow path substrate 31 and the vibration plate 33. The pressure chamber C1 is formed for each nozzle N. As illustrated in FIG. 2, the plurality of pressure chambers C1 are arranged along the Y-axis. Among the plurality of pressure chambers C1, the pressure chamber C1 communicating with the first nozzle Nu is a first pressure chamber C1*u*, and the pressure chamber C1 communicating with the second nozzle Nv is a second pressure chamber C1*v*. Further, the flow path substrate 31 and the pressure chamber substrate 32 are manufactured by processing a single crystal substrate of silicon using, for example, a semiconductor manufacturing technology, similarly to the nozzle plate 41 described above. However, a known material and a manufacturing method can be arbitrarily adopted for manufacturing the flow path substrate 31 and the pressure chamber substrate 32.

As illustrated in FIG. 3, the elastically deformable vibration plate 33 is disposed above the pressure chamber C1. The vibration plate 33 is stacked on the pressure chamber substrate 32 and is in contact with a surface of the pressure chamber substrate 32 opposite to the flow path substrate 31. The vibration plate 33 is a plate-shaped member formed in a long rectangular shape along the Y-axis in plan view. A thickness direction of the vibration plate 33 is parallel to a direction along the Z-axis. As illustrated in FIGS. 2 and 3, the pressure chamber C1 communicates with the communication flow path 314 and the supply flow path 312. Accordingly, the pressure chamber C1 communicates with the nozzle N via the communication flow path 314, and communicates with the space Ra via the supply flow path 312 and the relay liquid chamber 316. In FIG. 2, the pressure chamber substrate 32 and the vibration plate 33 are illustrated as separate substrates for ease of explanation, but in practice, are stacked on one silicon substrate. A portion or the whole of the vibration plate 33 may be a separate member from the pressure chamber substrate 32 or may be integrated.

As illustrated in FIGS. 2 and 3, the piezoelectric element 34 is formed for each pressure chamber C1 on the surface of the vibration plate 33 opposite to the pressure chamber C1. The piezoelectric element 34 is provided to correspond to the pressure chamber C1. Specifically, one piezoelectric element 34 overlaps one pressure chamber C1 in plan view. As illustrated in FIG. 2, among the plurality of piezoelectric elements 34, the piezoelectric element 34 provided to correspond to the first pressure chamber C1*u* is a first piezoelectric element 34*u*, and the piezoelectric element 34 provided to correspond to the second pressure chamber C1*v* is a second piezoelectric element 34*v*. The piezoelectric element 34 is a long-shaped passive element along the X-axis in plan view. The piezoelectric element 34 generates a pressure for discharging an ink. That is, the piezoelectric element 34 changes the pressure of the ink in the pressure chamber C1.

As illustrated in FIG. 2, the plurality of piezoelectric elements 34 are divided into a first piezoelectric element row L1 and a second piezoelectric element row L2 arranged side by side at an interval from each other along the X-axis. Each of the first piezoelectric element row L1 and the second piezoelectric element row L2 is a set of the plurality of piezoelectric elements 34 linearly arranged along the Y-axis. The second piezoelectric element row L2 is provided at a different position in an intersecting direction intersecting the first piezoelectric element row L1 in a predetermined direction. The predetermined direction is a direction along the Y-axis, and is a direction in which the plurality of piezoelectric elements 34 included in the first piezoelectric element row L1 are aligned. It can be said that the predetermined direction is a direction in which the plurality of piezoelectric elements 34 included in the second piezoelectric element row L2 are aligned. The intersecting direction is a direction along the X-axis, and is a direction in which the first piezoelectric element row L1 and the second piezoelectric element row L2 are aligned.

The casing portion 36 in FIG. 3 is a case for reserving an ink supplied to the plurality of pressure chambers C1, and is formed by, for example, injection molding of a resin material. A space Rb and a supply port 361 are formed in the casing portion 36. The supply port 361 is a pipeline to which an ink is supplied from the liquid container 14, and communicates with the space Rb. The space Rb of the casing portion 36 and the space Ra of the flow path substrate 31 communicate with each other. A space formed by the space Ra and the space Rb functions as a liquid reserve chamber R that reserves an ink supplied to the plurality of pressure chambers C1. The ink supplied from the liquid container 14 and passed through the supply port 361 is reserved in the liquid reserve chamber R. The ink reserved in the liquid reserve chamber R branches from the relay liquid chamber 316 to each supply flow path 312, and is supplied to and filled into a plurality of pressure chambers C1 in parallel. The vibration absorber 42 is a flexible film or plate constituting a wall surface of the liquid reserve chamber R, and absorbs a pressure fluctuation of the ink in the liquid reserve chamber R.

The protection portion 35 is a structure that protects the plurality of piezoelectric elements 34 and reinforces the mechanical strength of the pressure chamber substrate 32 and the vibration plate 33. The protection portion 35 is manufactured by, for example, processing a single crystal substrate of silicon using a semiconductor manufacturing technology. The protection portion 35 will be described later in detail. Further, the wiring substrate 51 is bonded to a surface of the vibration plate 33. The wiring substrate 51 is a mounting component on which a plurality of wirings for electrically coupling the control unit 20 and the liquid discharge head 26 are formed. For example, the flexible wiring substrate 51 such as a flexible printed circuit (FPC) or a flexible flat cable (FFC) is suitably adopted. A drive signal for driving the piezoelectric element 34 and a reference voltage are supplied to each piezoelectric element 34 from the wiring substrate 51.

1-3. Configuration of Actuator 3

Figure 4:
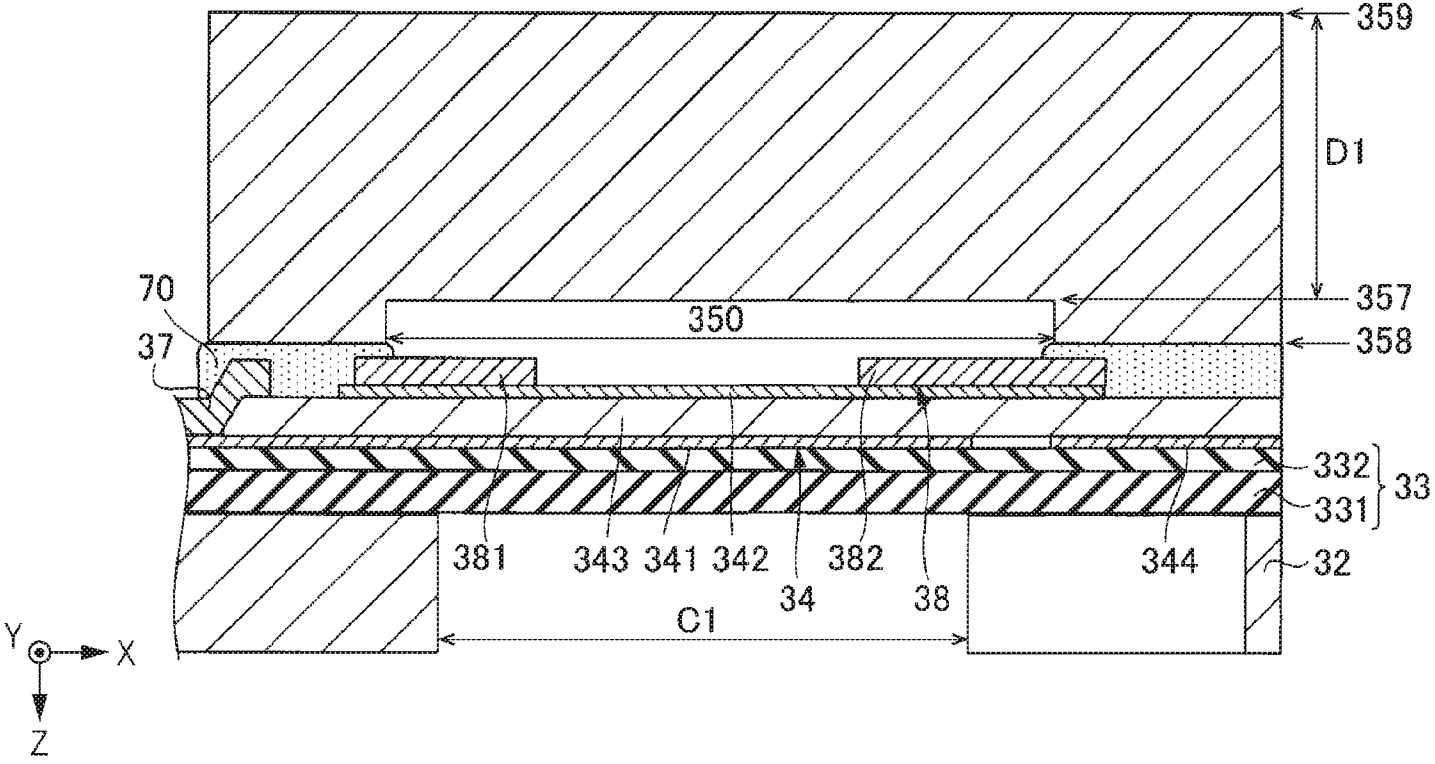
FIG. 4 is an enlarged sectional view of a portion of an actuator.

FIG. 4 is an enlarged sectional view of a portion of the actuator 3. FIG. 4 illustrates elements related to the first piezoelectric element row L1. In the present embodiment, an element related to the first piezoelectric element row L1 illustrated in FIG. 2 and an element related to the second piezoelectric element row L2 are disposed substantially in plane symmetry. Accordingly, in the following description, an element corresponding to the first piezoelectric element row L1 will be mainly described, and the description of an element corresponding to the second piezoelectric element row L2 will be appropriately omitted.

As illustrated in FIG. 4, the actuator 3 is constituted with the vibration plate 33 and the plurality of piezoelectric elements 34 described above. The actuator 3 changes a pressure of the pressure chamber C1 by a drive signal being applied.

1-3a. Configuration of Vibration Plate 33

As illustrated in FIG. 4, the vibration plate 33 includes a first layer 331 and a second layer 332. The first layer 331 is stacked on the pressure chamber substrate 32. The first layer 331 has a portion that is in contact with the pressure chamber substrate 32 and a portion that overlaps the pressure chamber C1 in plan view. The first layer 331 is an elastic film formed of silicon oxide such as silicon dioxide ($SiO_2$). The second layer 332 is stacked on the first layer 331. The second layer 332 is disposed between the first layer 331 and the piezoelectric element 34, and is in contact with both the first layer 331 and the piezoelectric element 34. The second layer 332 is an insulating layer formed of zirconium oxide such as zirconium dioxide ($ZrO_2$). A metal layer 344 filling a space between the second layer 332 and a piezoelectric body 343 described below is disposed. The metal layer 344 is insulated from a first electrode 341.

Each of the first layer 331 and the second layer 332 is formed by a known film forming technology such as thermal oxidation or sputtering. For example, by selectively removing a portion of an area corresponding to the pressure chamber C1 in a thickness direction in a plate-shaped member having a predetermined thickness, it is possible to integrally form the pressure chamber substrate 32 and a portion or entirety of the vibration plate 33.

1-3b. Configuration of Piezoelectric Element 34

As illustrated in FIG. 4, the piezoelectric element 34 is a structure body in which the first electrode 341, the piezoelectric body 343, and a second electrode 342 are stacked in the above order from a side of the vibration plate 33. The Z-axis corresponds to an-axis along a direction in which the first electrode 341, the piezoelectric body 343, and the second electrode 342 are stacked. In the present disclosure, the expression "an element B is formed on the surface of an element A" is not limited to a configuration in which the element A and the element B are in direct contact. That is, even in a configuration in which an element C is formed on the surface of the element A and the element B is formed on the surface of the element C, when the configuration is such that a portion or entirety of the element A and the element B overlap in plan view, the configuration is included in the concept of "an element B is formed on the surface of an element A".

The first electrode 341 is formed on the surface of the vibration plate 33. The first electrode 341 is an individual electrode formed apart from each other for each piezoelectric element 34. The first electrode 341 has a long shape along the X-axis. A plurality of first electrodes 341 are arranged along the Y-axis at an interval from each other. The first electrode 341 is formed of, for example, a conductive material such as platinum (Pt) or iridium (Ir). A first wiring 37 is electrically coupled to the first electrode 341. The first wiring 37 is a lead wiring to which a drive signal is supplied from the wiring substrate 51 illustrated in FIG. 3, and supplies the drive signal to the first electrode 341. The first electrode 341 is an example of an electrode that applies a voltage to the piezoelectric body 343. The first wiring 37 is formed of a conductive material having a lower resistance than the first electrode 341. For example, the first wiring 37 is a conductive pattern having a structure in which a conductive film of gold (Au) is stacked on a surface of a conductive film formed of nichrome (NiCr).

The piezoelectric body 343 is formed above the first electrode 341 and is in contact with the first electrode 341. The piezoelectric body 343 is a strip-shaped dielectric film that extends along the Y-axis over the plurality of piezoelectric elements 34. The piezoelectric body 343 is common to the plurality of piezoelectric elements 34. The piezoelectric body 343 is formed of a known piezoelectric material such as, for example, lead zirconate titanate ($Pb(Zr, Ti)O_3$). Although not illustrated in detail, a notch along the X-axis is formed in an area of the piezoelectric body 343 corresponding to a gap between the pressure chambers C1 adjacent to each other. The notch is an opening that penetrates the piezoelectric body 343. By forming the notch, each piezoelectric element 34 is individually deformed for each pressure chamber C1, and propagation of vibration between the piezoelectric elements 34 is suppressed. A bottomed hole obtained by removing a portion of the piezoelectric body 343 in a thickness direction may be formed as the notch.

The second electrode 342 is formed above the piezoelectric body 343 and is in contact with the piezoelectric body 343. The second electrode 342 is a strip-shaped common electrode extending along the Y-axis to be continuous over the plurality of piezoelectric elements 34. A predetermined reference voltage is applied to the second electrode 342. The reference voltage is a constant voltage, and is, for example, set to a voltage higher than a ground voltage. A voltage corresponding to a difference between a reference voltage applied to the second electrode 342 and a drive signal supplied to the first electrode 341 is applied to the piezoelectric body 343. A ground voltage may be applied to the second electrode 342. Further, the second electrode 342 is formed of, for example, a low-resistance conductive material such as platinum (Pt) or iridium (Ir). Further, the second electrode 342 may be regarded as an electrode applying a voltage to the piezoelectric body 343.

A second wiring 38 that is electrically coupled to the second electrode 342 is formed on a surface of the second electrode 342. A reference voltage (not illustrated) is supplied to the second wiring 38 via a wiring substrate 51 illustrated in FIG. 3. As illustrated in FIG. 4, the second wiring 38 has a strip-shaped first conductive layer 381 extending along the Y-axis and a strip-shaped second conductive layer 382 extending along the Y-axis. The first conductive layer 381 and the second conductive layer 382 are aligned at a predetermined interval along the X-axis. The first conductive layer 381 and the second conductive layer 382 are provided, so that a voltage drop of a reference voltage in the second electrode 342 is suppressed. Further, the first conductive layer 381 and the second conductive layer 382 also function as weights for suppressing the vibration of the vibration plate 33. The second wiring 38 is formed of a conductive material having a lower resistance than the second electrode 342. For example, the second wiring 38 is a conductive pattern having a structure in which a conductive film of gold (Au) is stacked on a surface of a conductive film formed of nichrome (NiCr). The first conductive layer 381 and the second conductive layer 382 are electrically coupled at an end portion in the +Y direction and an end portion in the −Y direction (not illustrated).

The piezoelectric body 343 is deformed by applying a voltage between the first electrode 341 and the second electrode 342, so that the piezoelectric element 34 generates energy for bending and deforming the vibration plate 33. The vibration plate 33 vibrates by the energy generated by the piezoelectric element 34, so that the pressure of the pressure chamber C1 changes and the ink in the pressure chamber C1 is discharged from the nozzle N illustrated in FIG. 3.

1-4. Configuration of Protection Portion 35

Figure 5:
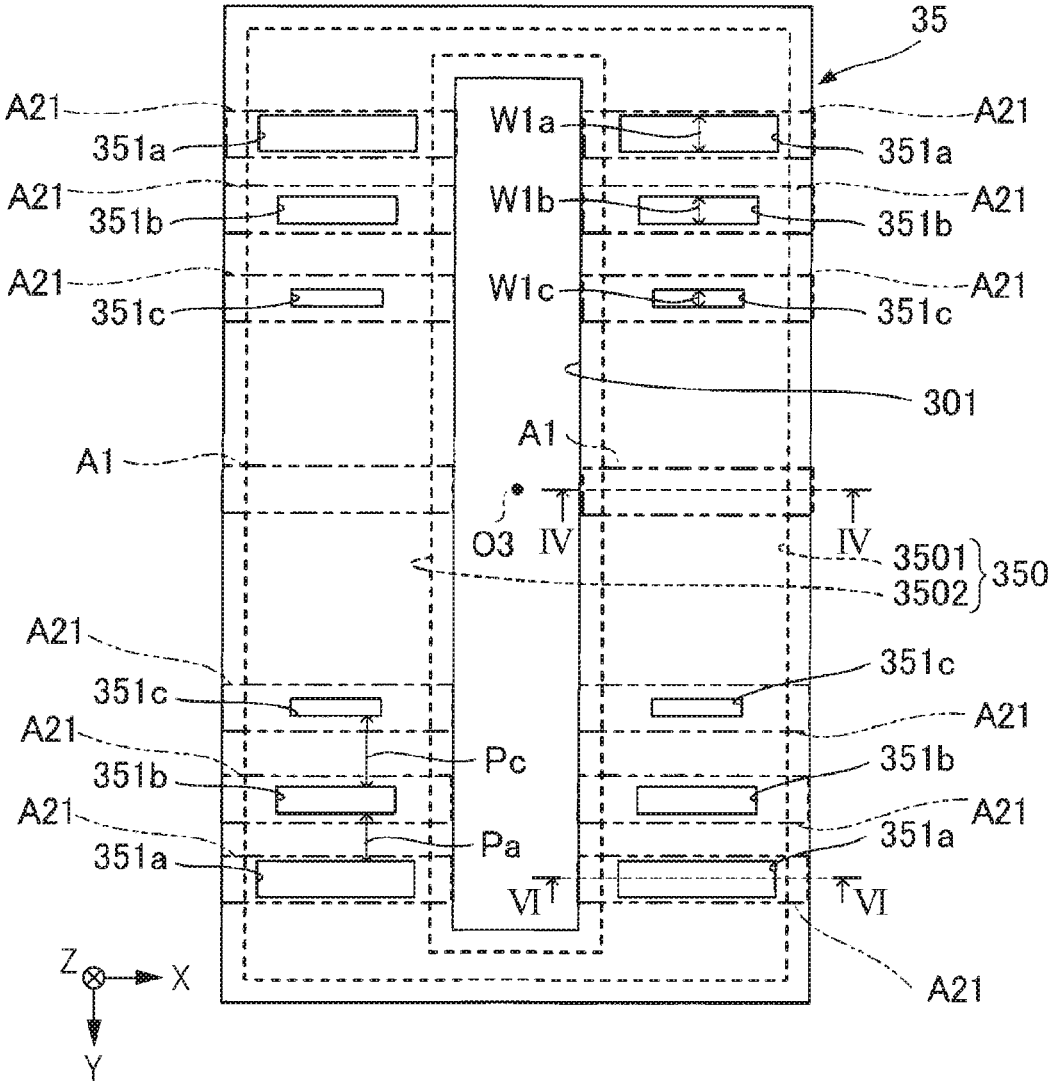
FIG. 5 is a plan view of a protection portion.
Figure 6:
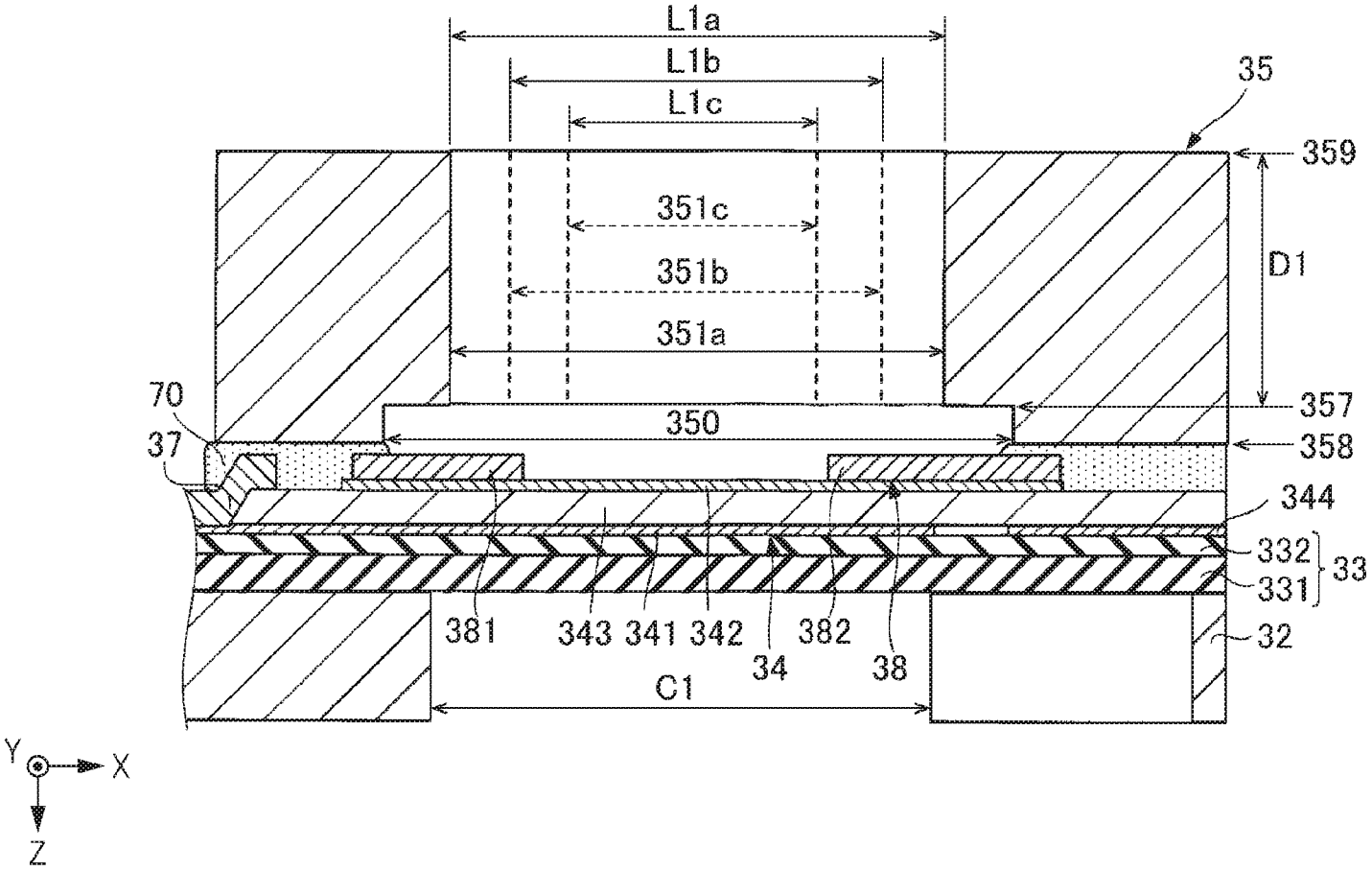
FIG. 6 is a sectional view taken along a line VI-VI in FIG. 5.

The protection portion 35 will be described in detail with reference to FIGS. 4, 5, and 6. FIG. 5 is a plan view of the protection portion 35. FIG. 6 is a sectional view taken along a line VI-VI in FIG. 5. Further, FIG. 4 corresponds to a sectional view taken along a line IV-IV in FIG. 5.

As illustrated in FIG. 4, the protection portion 35 is positioned opposite to the pressure chamber C1 with respect to the piezoelectric element 34. The protection portion 35 is fixed to the actuator 3 with an adhesive 70. By providing the protection portion 35, the thin actuator 3 can be protected. For example, it is possible to suppress the possibility that the actuator 3 is damaged during manufacturing.

As illustrated in FIG. 5, the protection portion 35 is a long plate-shaped member along the Y-axis. At the center of the protection portion 35, a wiring hole 301 through which the wiring substrate 51 is inserted is provided. The wiring hole 301 is a hole penetrating the protection portion 35. The wiring hole 301 is formed along the thickness direction of the protection portion 35. A shape of the wiring hole 301 in plan view is a long shape along the Y-axis.

As illustrated in FIGS. 4 and 5, an element recess portion 350 is formed in the protection portion 35. The element recess portion 350 is a recess formed in the facing surface 358 of the protection portion 35 with the vibration plate 33. The element recess portion 350 forms a space commonly formed at the plurality of piezoelectric elements 34. The element recess portion 350 allows displacement of the piezoelectric element 34 by the vibration.

As illustrated in FIG. 5, the element recess portion 350 has a rectangular frame shape and surrounds the wiring hole 301 in plan view. The element recess portion 350 includes a portion 3501 and a portion 3502. The portion 3501 has a long shape along the Y-axis in the element recess portion 350 and is positioned on the +X-axis with respect to the wiring hole 301 in plan view. The portion 3502 has a long shape along the Y-axis in the element recess portion 350 and is positioned on the −X-axis with respect to the wiring hole 301 in plan view. The portion 3501 overlaps the first piezoelectric element row L1 illustrated in FIG. 2 in plan view. The portion 3502 overlaps the second piezoelectric element row L2 illustrated in FIG. 2 in plan view.

As illustrated in FIG. 6, a thickness D1 of the protection portion 35 is larger than a thickness of the actuator 3. The thickness D1 is a length along the Z-axis from a bottom surface 357 of the element recess portion 350 of the protection portion 35 to an upper surface 359. The thickness of the actuator 3 is a length along the Z-axis from a lower surface of the vibration plate 33 to an upper surface of the second electrode 342. A thickness that is a length from the facing surface 358 to the upper surface 359 along the Z-axis in the protection portion 35 is also thicker than the thickness of the actuator 3. The rigidity of the protection portion 35 is higher than the rigidity of the actuator 3.

As illustrated in FIGS. 5 and 6, the protection portion 35 is provided with a plurality of first through holes 351*a*, a plurality of second through holes 351*b*, and a plurality of third through holes 351*c*. In the present disclosure, the first through hole 351*a*, the second through hole 351*b*, and the third through hole 351*c* are referred to as a through hole 351 when not distinguished.

As illustrated in FIG. 6, the through hole 351 is a hole that passes through the protection portion 35. The through hole 351 is formed along the thickness direction of the protection portion 35 and communicates with the element recess portion 350. Accordingly, the through hole 351 opens both on the upper surface 359 of the protection portion 35 and on the bottom surface 357 of the element recess portion 350. Further, the through hole 351 is provided at a position different from a center O3 of the protection portion 35 in a direction along the X-axis. That is, the through hole 351 is a hole different from the wiring hole 301 described above. Further, a volume of the through hole 351 is smaller than a volume of the wiring hole 301. By providing such a through hole 351, the rigidity of the protection portion 35 can be reduced, and a resonance frequency of each piezoelectric element 34 can be adjusted.

As illustrated in FIG. 5, a shape of the through hole 351 in plan view is a rectangular shape whose longitudinal direction is along the X-axis. The through hole 351 is formed at a position closer to an end in the Y-axis than the center O3 of the protection portion 35 in plan view. Further, the through hole 351 overlaps the piezoelectric element 34 in plan view. One through hole 351 may overlap one piezoelectric element 34 or may overlap the plurality of piezoelectric elements 34 in plan view.

The plurality of through holes 351 are divided into a row corresponding to the first piezoelectric element row L1 and a row corresponding to the second piezoelectric element row L2 illustrated in FIG. 2. The plurality of through holes 351 belonging to the row corresponding to the first piezoelectric element row L1 are aligned with the Y-axis. As illustrated in FIG. 5, the plurality of through holes 351 positioned on a side of the +X-axis with respect to the wiring hole 301 in plan view are aligned with a row along the Y-axis. Similarly, the plurality of through holes 351 belonging to the row corresponding to the second piezoelectric element row L2 illustrated in FIG. 2 are aligned with the Y-axis. As illustrated in FIG. 5, the plurality of through holes 351 positioned on a side of the −X-axis with respect to the wiring hole 301 in plan view are aligned with a row along the Y-axis.

As illustrated in FIGS. 5 and 6, a volume of the second through hole 351*b* is smaller than a volume of the first through hole 351*a* and larger than a volume of the third through hole 351*c*. As illustrated in FIG. 5, a width W1*b* of the second through hole 351*b* is smaller than a width W1*a* of the first through hole 351*a* and larger than a width W1*c* of the third through hole 351*c*. The widths W1*a*, W1*b*, and W1*c* are lengths along the Y-axis. As illustrated in FIG. 6, a length L1*b* of the second through hole 351*b* is shorter than a length L1*a* of the first through hole 351*a* and longer than a length L1*c* of the third through hole 351*c*. The lengths L1*a*, L1*b*, and L1*c* are lengths along the X-axis.

As illustrated in FIG. 5, an interval Pa between the second through hole 351*b* and the first through hole 351*a* is larger than an interval Pc between the second through hole 351*b* and the third through hole 351*c*. The interval Pa is a separation distance between the second through hole 351*b* and the first through hole 351*a*. The interval Pc is a separation distance between the second through hole 351*b* and the third through hole 351*c*.

Here, as described above, the rigidity of the protection portion 35 is higher than the rigidity of the actuator 3. Accordingly, when the protection portion 35 is bonded to the actuator 3, the actuator 3 is pressed by the protection portion 35, and the actuator 3 has a strong tendency to hardly vibrate. Accordingly, a resonance frequency of the piezoelectric element 34 is increased, and as a result, the discharge performance such as a discharge amount may be reduced. Further, for example, the variation in the resonance frequency is likely to occur in each piezoelectric element 34 by manufacture variations or the like. Accordingly, the resonance frequency of the piezoelectric element 34 having a high resonance frequency compared to resonance frequencies of the other piezoelectric elements 34 tends to be further increased by the provision of the protection portion 35. As a result, a desired discharge amount may not be obtained. Accordingly, in the protection portion 35, the through hole 351 is provided.

It is assumed that a portion of the protection portion 35 that does not include the through hole 351 is a first portion A1 and a portion of the protection portion 35 that includes the through hole 351 is a second portion A21. Lengths of the first portion A1 and the second portion A21 along the X-axis, the Y-axis, and the Z-axis are equal. In the protection portion 35, the rigidity of the first portion A1 is higher than the rigidity of the second portion A21. In this manner, the protection portion 35 has the second portion A21 having the lower rigidity than the rigidity of the first portion A1, so that the rigidity of the protection portion 35 can be reduced compared to a case where the second portion A21 is not provided. Accordingly, the actuator 3 can be more easily vibrated compared to a case where the second portion A21 is not provided. As a result, since an average resonance frequency in the plurality of piezoelectric elements 34 can be reduced, a reduction in a discharge amount by the provision of the protection portion 35 can be suppressed. Accordingly, it is possible to suppress a decrease in a discharge amount and protect the actuator 3 with the protection portion 35.

Further, by providing the second portion A21 in the protection portion 35 to adjust the rigidity of the protection portion 35 to correct the distribution of the resonance frequency of each piezoelectric element 34, the variation in the resonance frequency of each piezoelectric element 34 can be adjusted. Accordingly, although there is the variation in the resonance frequency by, for example, manufacture variations, it is possible to reduce the variation in the resonance frequency by providing the through hole 351 to adjust the distribution of the resonance frequency of the piezoelectric element 34 and the rigidity of the protection portion 35. Accordingly, it is possible to reduce the variation in an ink discharge amount or the like.

For example, in the actuator 3, the variation in resonance frequency is likely to occur along a direction in which the plurality of piezoelectric elements 34 are aligned, that is, along the Y-axis. Specifically, for example, a resonance frequency on a side of the end is likely to be higher than on the center of the first piezoelectric element row L1. Accordingly, by providing the second portion A21 on a side of the end rather than on the center of the first piezoelectric element row L1, the variation in the resonance frequency can be reduced. Stated another way, as illustrated in FIG. 5, by providing the through hole 351 at a position closer to the end than to the center O3 of the protection portion 35, it is possible to reduce the variation in the resonance frequency. The same applies to the portion of the protection portion 35 corresponding to the second piezoelectric element row L2.

The disposition of the second portion A21 in the protection portion 35 is not limited to the illustrated example. By providing the second portion A21 at an arbitrary position according to the distribution of the resonance frequency of each piezoelectric element 34, the variation of the resonance frequency can be effectively reduced.

As illustrated in FIG. 5, a plurality of second portions A21 including the through holes 351 are provided at different positions in a direction along the Y-axis which is a predetermined direction. Accordingly, the variation in the resonance frequency can be more effectively reduced compared to a case where there is one second portion A21. Accordingly, it is possible to further reduce the variation in an ink discharge amount or the like. The number of the second portions A21 is not limited to the number illustrated, and may be one or may be a plurality other than six.

When the resonance frequency is higher as it goes from the center of the first piezoelectric element row L1 toward the end, as illustrated in FIG. 5, the variation in the resonance frequency can be particularly preferably reduced by increasing the volume of the through hole 351 as it goes from the center O3 of the protection portion 35 toward the end. Further, when the resonance frequency is higher as it goes from the center of the first piezoelectric element row L1 toward the end, as illustrated in FIG. 5, the variation in the resonance frequency can be preferably reduced by making the interval Pa larger than the interval Pc. The same applies to the portion of the protection portion 35 corresponding to the second piezoelectric element row L2.

Further, by providing the through hole 351 so that the rigidity of the second portion A21 is lower than the rigidity of the first portion A1, the rigidity of the second portion A21 can be easily reduced compared to the rigidity of the first portion A1. Accordingly, for example, by providing the through hole 351 after manufacturing the actuator 3, the resonance frequency can be easily adjusted. Accordingly, the variation in the resonance frequency by manufacture variations can be easily and appropriately suppressed.

According to the liquid discharge apparatus 100 including the liquid discharge head 26 described above, the liquid discharge head 26 operates under control of the control unit 20, so that the variation in the discharge performance can be suppressed. Accordingly, according to the liquid discharge apparatus 100, highly accurate liquid discharge can be realized.

Further, as the plurality of nozzles N are disposed at a higher density, the thickness of the actuator 3 tends to be reduced to secure a necessary deformation amount of the actuator 3. By reducing the thickness of the actuator 3, the actuator 3 is easily affected by the protection portion 35. Although the density of the nozzle N is increased, the liquid discharge head 26 can effectively suppress the variation in the discharge performance.

In the present embodiment, each volume of the first through hole 351*a*, the second through hole 351*b*, and the third through hole 351*c* is different, but the relationship between the volumes is not limited to the illustrated example. For example, each volume may be the same. Similarly, the widths W1*a*, W1*b* and W1*c* are different from each other, but may be equal to each other. Further, the lengths L1*a*, L1*b*, and L1*c* are different from each other, but may be equal to each other. Further, by changing only any of the widths W1*a*, W1*b* and W1*c* and the lengths L1*a*, L1*b* and L1*c*, each volume of the first through hole 351*a*, the second through hole 351*b* and the third through hole 351*c* may be adjusted. Further, the interval Pa and the interval Pc may be equal to each other. The interval Pc may be larger than the interval Pa. The plurality of through holes 351 may be aligned at an equal interval along the Y-axis. Further, a shape of each through hole 351 is not limited to the illustrated example, and is arbitrary. For example, a shape of each through hole 351 in plan view may be a circle or a polygon other than a quadrangle. The number of through holes 351 is not limited to the number illustrated, and may be one or may be a plurality other than six.

2. Second Embodiment

A second embodiment will be described. In each of the following examples, the elements having the same functions as those of the first embodiment will be denoted by the same reference numerals used in the description of the first embodiment, and detailed description thereof will be omitted as appropriate.

Figure 7:
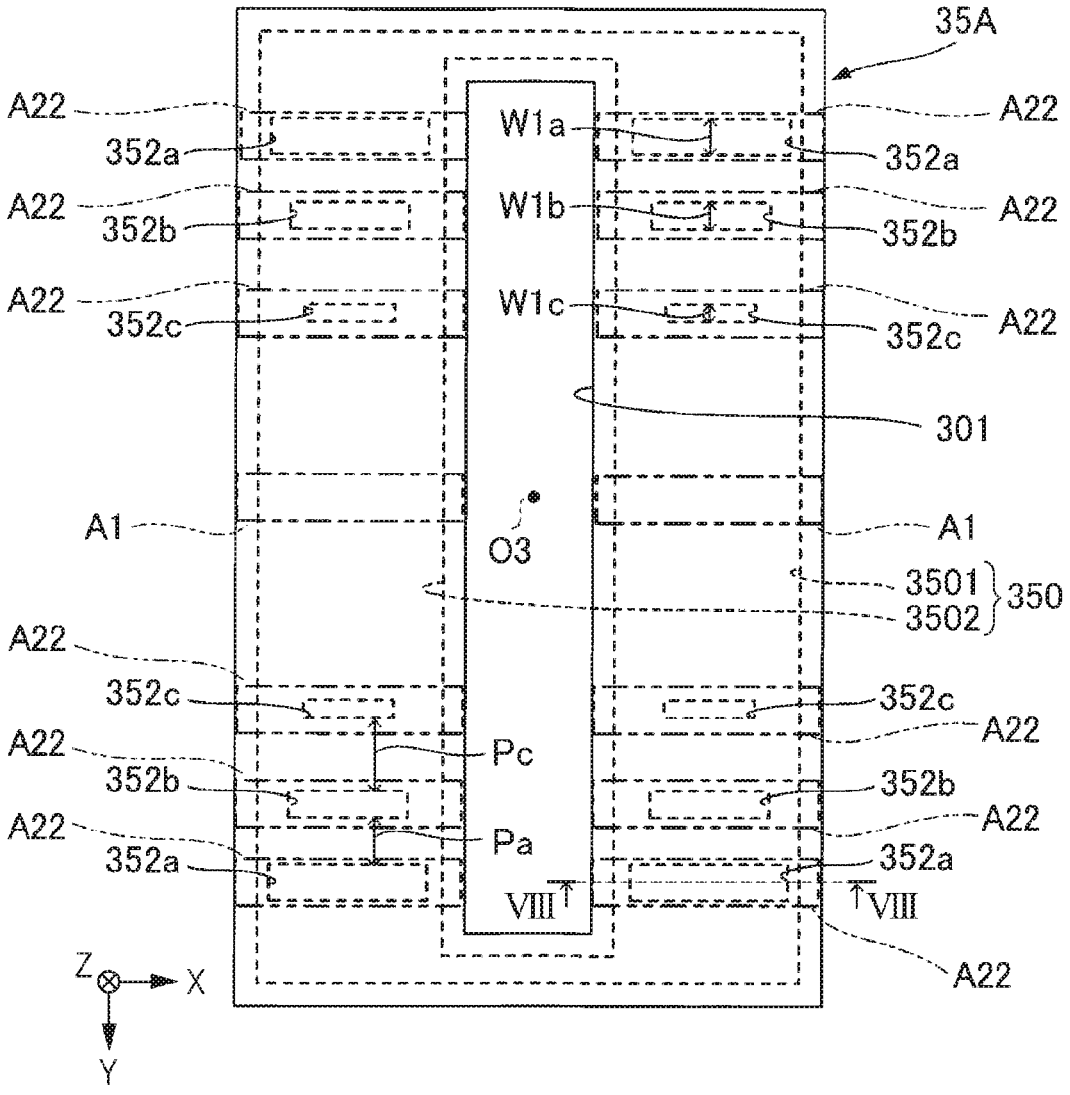
FIG. 7 is a plan view of a protection portion in a second embodiment.
Figure 8:
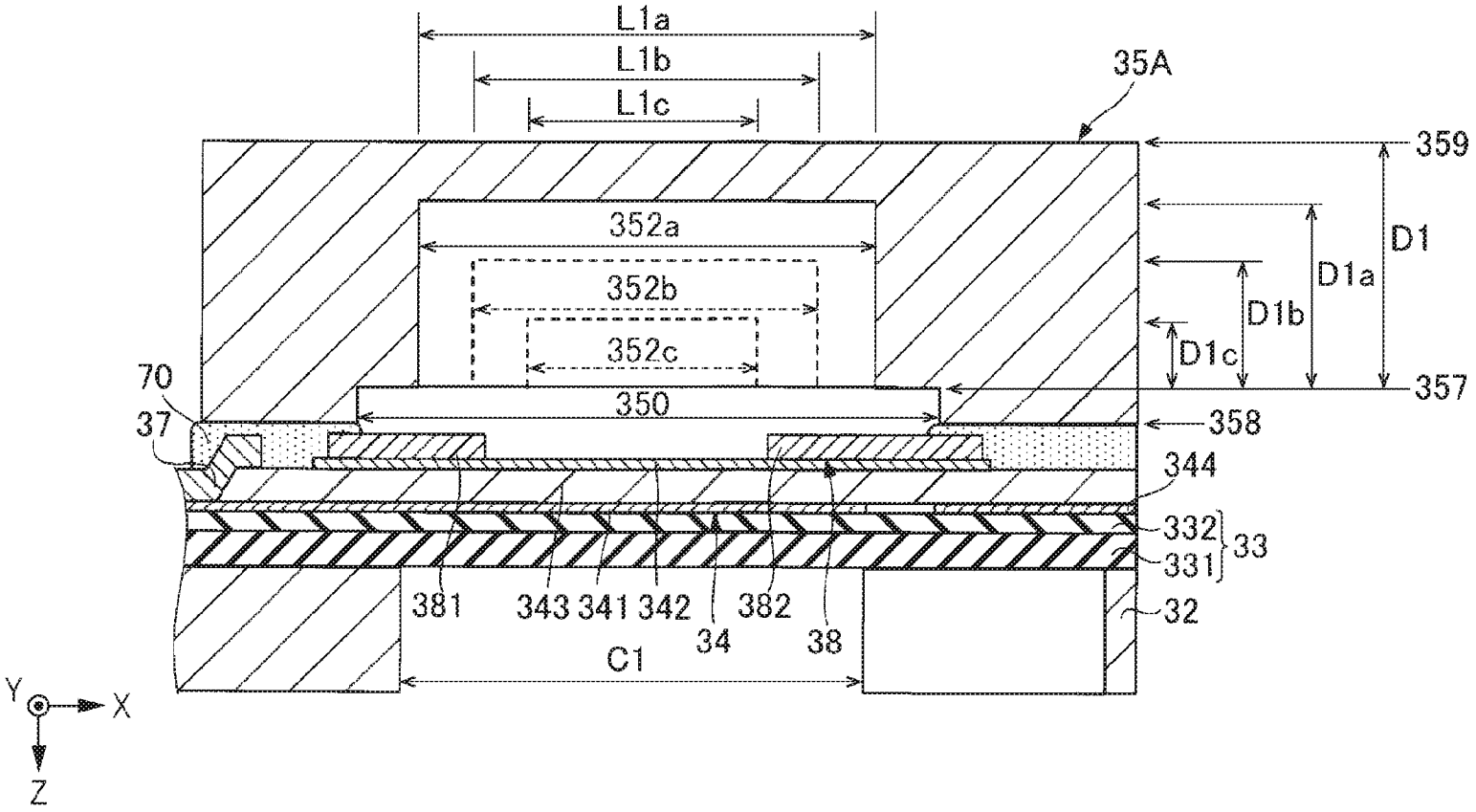
FIG. 8 is a sectional view taken along a line VIII-VIII in FIG. 7.

FIG. 7 is a plan view of a protection portion 35A according to the second embodiment. FIG. 8 is a sectional view taken along a line VIII-VIII in FIG. 7. As illustrated in FIGS. 7 and 8, the protection portion 35A is provided with a plurality of first recess portions 352*a*, a plurality of second recess portions 352*b*, and a plurality of third recess portions 352*c*. In the present disclosure, the first recess portion 352*a*, the second recess portion 352*b*, and the third recess portion 352*c* are referred to as a recess portion 352 when not distinguished. Further, regarding the shape, disposition, or the like of the recess portion 352, the description of the same contents as the shape, disposition, or the like of the through hole 351 in the first embodiment is appropriately omitted.

As illustrated in FIGS. 7 and 8, the recess portion 352 is a groove provided in a plurality of portions of the protection portion 35A on a side of the pressure chamber C1. The recess portion 352 is a recess formed on the bottom surface 357 of the element recess portion 350 and opens into the element recess portion 350. As illustrated in FIG. 8, a depth D1*b* of the second recess portion 352*b* is smaller than a depth D1*a* of the first recess portion 352*a*, and is larger than a depth D1*c* of the third recess portion 352*c*.

In the present embodiment, the second portion A22 is a portion including the recess portion 352 in the protection portion 35A. The first portion A1 is a portion that does not include the recess portion 352 in the protection portion 35B. Lengths of the first portion A1 and the second portion A22 along the X-axis, the Y-axis, and the Z-axis are equal. The rigidity of the first portion A1 is higher than the rigidity of the second portion A22.

By the protection portion 35A having the second portion A22, the rigidity of the protection portion 35A can be reduced compared to a case where the protection portion 35A does not have the second portion A22. Accordingly, also in the present embodiment, similarly to the first embodiment, the resonance frequency of each piezoelectric element 34 can be adjusted, and it is possible to suppress a decrease in the discharge amount by the provision of the protection portion 35A. Further, by providing the recess portion 352 in the protection portion 35A, it is possible to easily and appropriately suppress the variation in the resonance frequency by manufacture variations.

3. Third Embodiment

A third embodiment will be described. In each of the following examples, the elements having the same functions as those of the first embodiment will be denoted by the same reference numerals used in the description of the first embodiment, and detailed description thereof will be omitted as appropriate.

Figure 9:
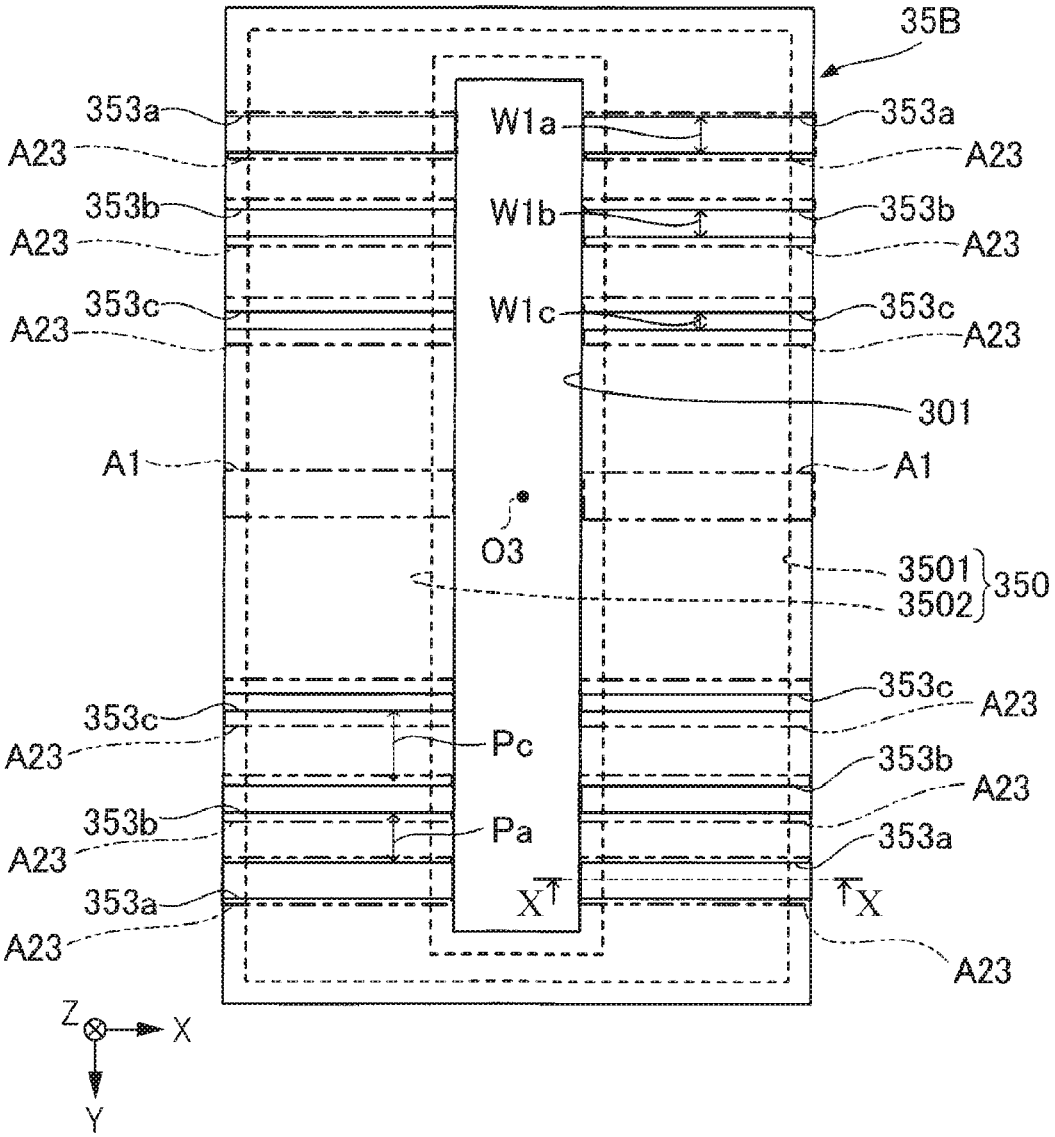
FIG. 9 is a plan view of a protection portion in a third embodiment.
Figure 10:
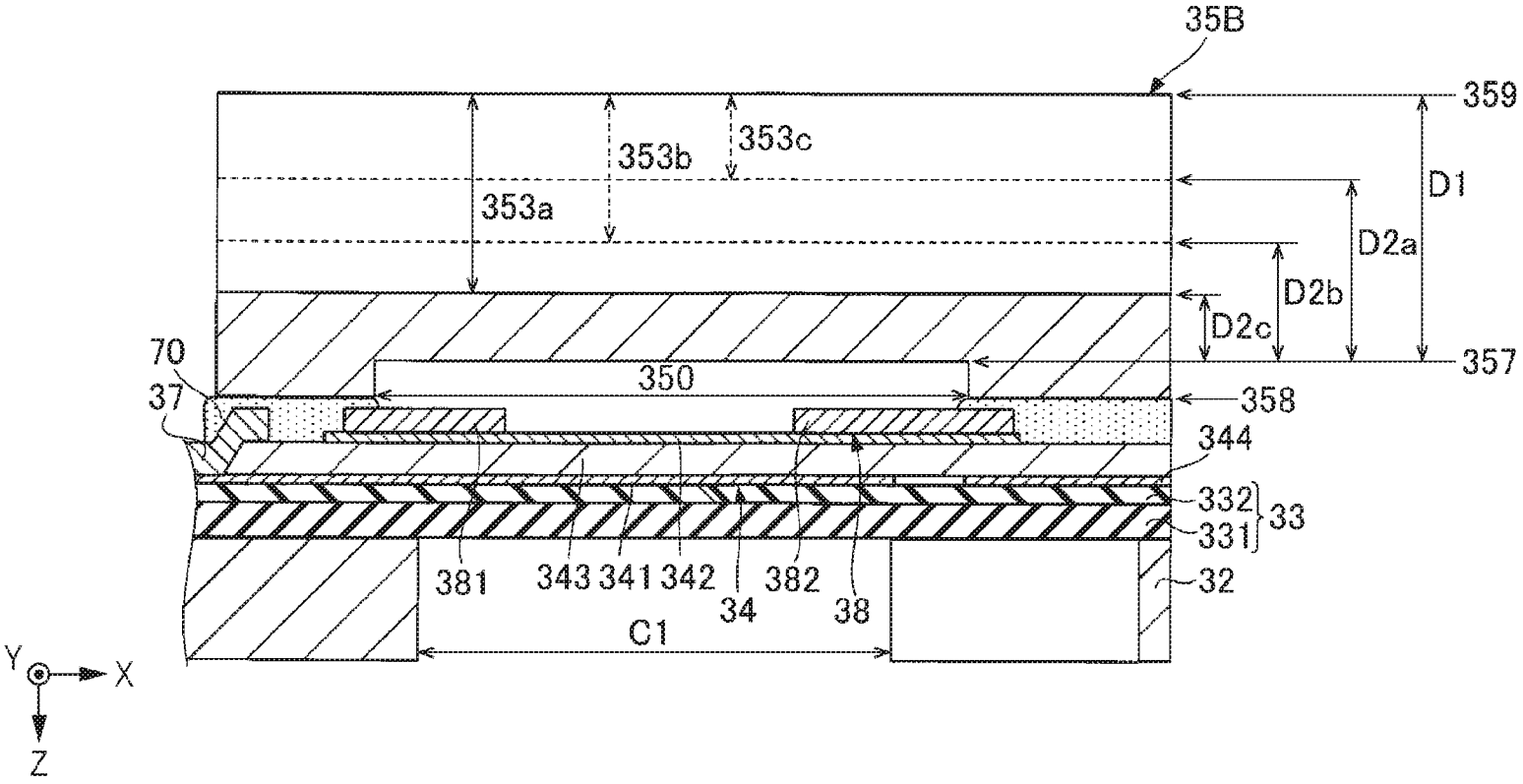
FIG. 10 is a sectional view taken along a line X-X in FIG. 9.

FIG. 9 is a plan view of a protection portion 35B according to the third embodiment. FIG. 10 is a sectional view taken along a line X-X in FIG. 9. As illustrated in FIGS. 9 and 10, a plurality of first slits 353*a*, a plurality of second slits 353*b*, and a plurality of third slits 353*c* are provided in the protection portion 35B. In the present disclosure, the first slit 353*a*, the second slit 353*b*, and the third slit 353*c* are described as a slit 353 when not distinguished. Further, regarding the shape, disposition, or the like of the slit 353, the description of the same contents as the shape, disposition, or the like of the through hole 351 in the first embodiment is appropriately omitted.

As illustrated in FIGS. 9 and 10, the slit 353 is a cut provided in a portion of the protection portion 35B opposite to the plurality of pressure chambers C1. The slit 353 opens the upper surface 359 and a side surface of the protection portion 35. A length of each slit 353 along the X-axis is equal to each other. As illustrated in FIG. 10, a thickness D2*b* of a portion in which the second slit 353*b* is provided is thinner than a thickness D2*a* of the portion in which the first slit 353*a* is provided, and is thicker than a thickness D2*c* of the portion in which the third slit 353*c* is provided. The thickness D2*a* is a length along the Z-axis between the bottom surface 357 of the element recess portion 350 and a bottom surface of the first slit 353*a*. However, the thickness D2*a* may be considered as a length along the Z-axis between the facing surface 358 and the bottom surface of the first slit 353*a*. The same applies to the thicknesses D2*b* and D2*c*.

In the present embodiment, the second portion A23 is a portion including the slit 353 in the protection portion 35B. The first portion A1 is a portion that does not include the slit 353 in the protection portion 35B. Lengths of the first portion A1 and the second portion A23 along the X-axis, the Y-axis, and the Z-axis are equal. The rigidity of the first portion A1 is higher than the rigidity of the second portion A23.

By the protection portion 35B having the second portion A23, the rigidity of the protection portion 35B can be reduced compared to a case where the protection portion 35B does not have the second portion A23. Accordingly, also in the present embodiment, similarly to the first embodiment, the resonance frequency of each piezoelectric element 34 can be adjusted, and it is possible to suppress a decrease in the discharge amount by the provision of the protection portion 35B. Further, for example, since the resonance frequency can be adjusted by providing the slit 353 after the manufacture of the actuator 3, the variation in the resonance frequency by manufacture variations can be easily and appropriately suppressed.

4. Fourth Embodiment

A fourth embodiment will be described. In each of the following examples, the elements having the same functions as those of the first embodiment will be denoted by the same reference numerals used in the description of the first embodiment, and detailed description thereof will be omitted as appropriate.

Figure 11:
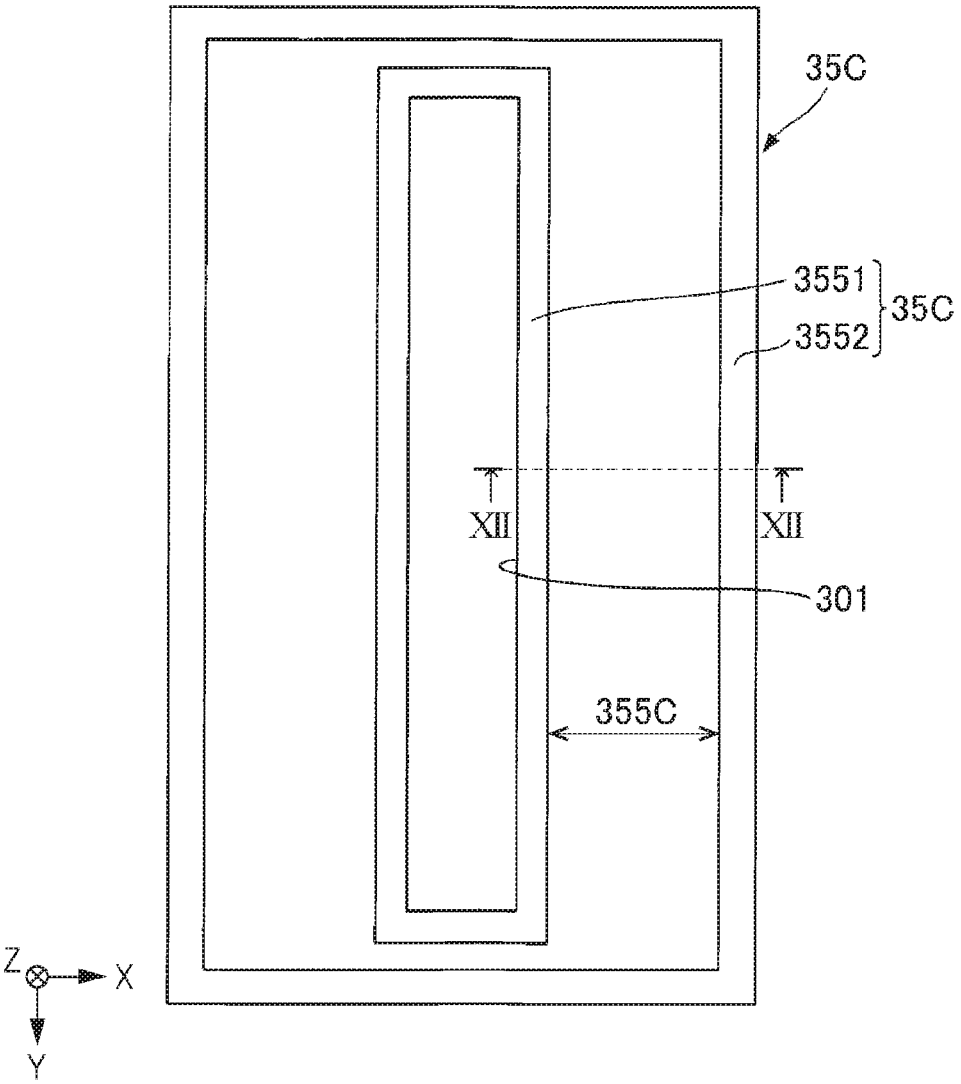
FIG. 11 is a plan view of a protection portion in a fourth embodiment.
Figure 12:
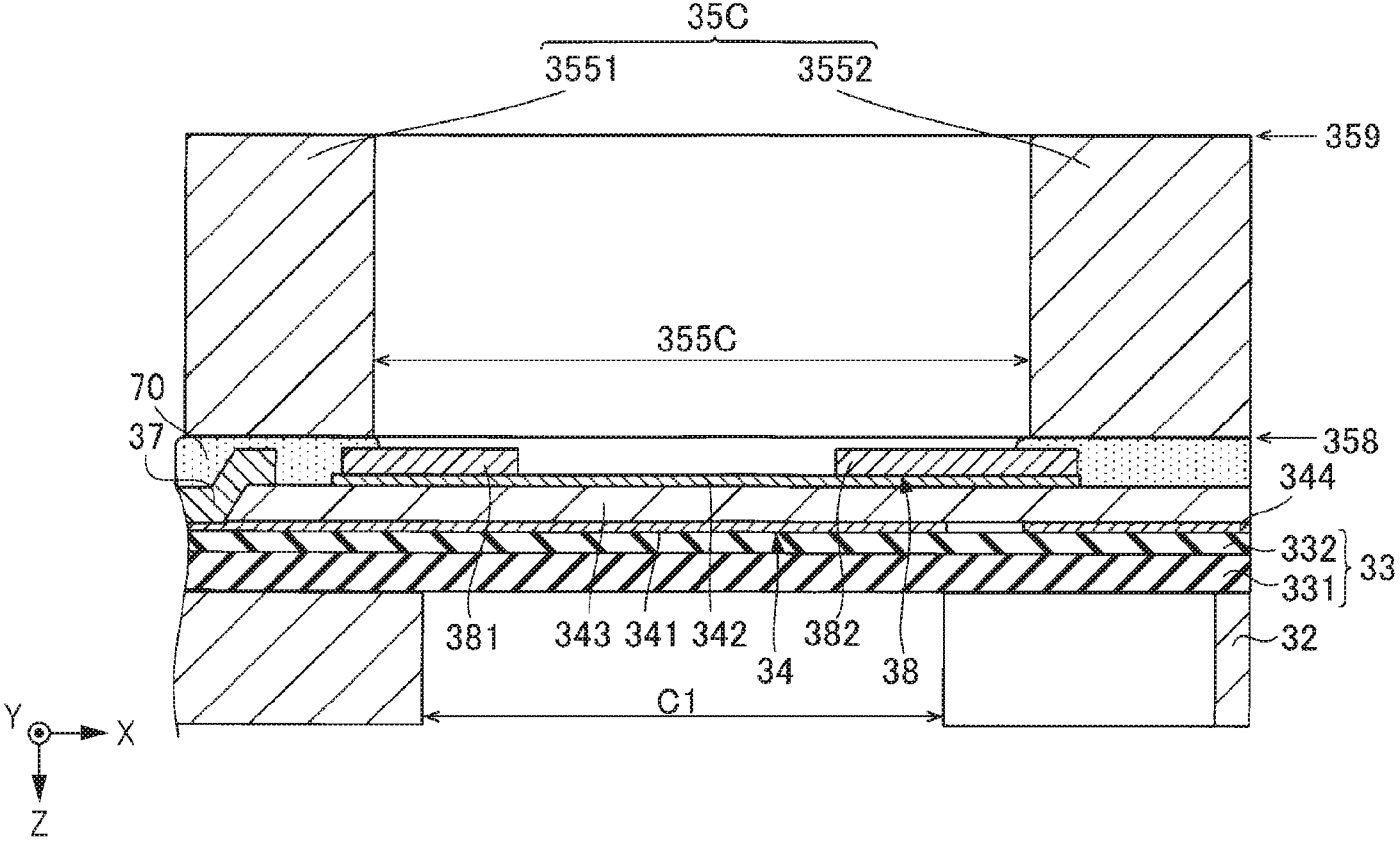
FIG. 12 is a sectional view taken along a line XII-XII in FIG. 11.

FIG. 11 is a plan view of a protection portion 35C in the fourth embodiment. FIG. 12 is a sectional view taken along a line XII-XII in FIG. 10. As illustrated in FIG. 11, the protection portion 35C has a first wall portion 3551 of a frame shape and a second wall portion 3552. Each of the first wall portion 3551 and the second wall portion 3552 has a wall shape along the Z-axis. The Z-axis is an axis along the thickness direction of the pressure chamber substrate 32 described above. The first wall portion 3551 and the second wall portion 3552 respectively protrude upward from the pressure chamber substrate 32. Further, the second wall portion 3552 surrounds the first wall portion 3551 in plan view. The first wall portion 3551 and the second wall portion 3552 are separated from each other, and a space 355C is provided between the first wall portion 3551 and the second wall portion 3552. That is, the protection portion 35C in the present embodiment does not have a portion that covers above the plurality of piezoelectric elements 34. Accordingly, the rigidity of the protection portion 35C can be particularly reduced. Accordingly, it is possible to particularly effectively suppress a decrease in discharge performance by the provision of the protection portion 35C.

As illustrated in FIG. 12, a portion of the protection portion 35C does not overlap the piezoelectric body 343. Further, the protection portion 35C is disposed to have vibration areas in the plurality of actuators 3 between in plan view. The protection portion 35C does not overlap a vibration area of the piezoelectric body 343 in plan view. Accordingly, the effect on the discharge performance by the provision of the protection portion 35C can be particularly reduced. The vibration area is an area of the vibration plate 33 that overlaps the pressure chamber C1 in plan view, and is an area that vibrates by the driving of the piezoelectric element 34. Further, in the present embodiment, a portion of the protection portion 35C overlaps the piezoelectric body 343 in plan view, but the entire protection portion 35C may not overlap the piezoelectric body 343.

5. Modification Example

The embodiment illustrated above can be variously modified. An aspect of a specific modification that can be applied to the embodiment described above will be illustrated below. Two or more aspects arbitrarily selected from the following examples can be appropriately combined within a mutually consistent range.

Figure 13:
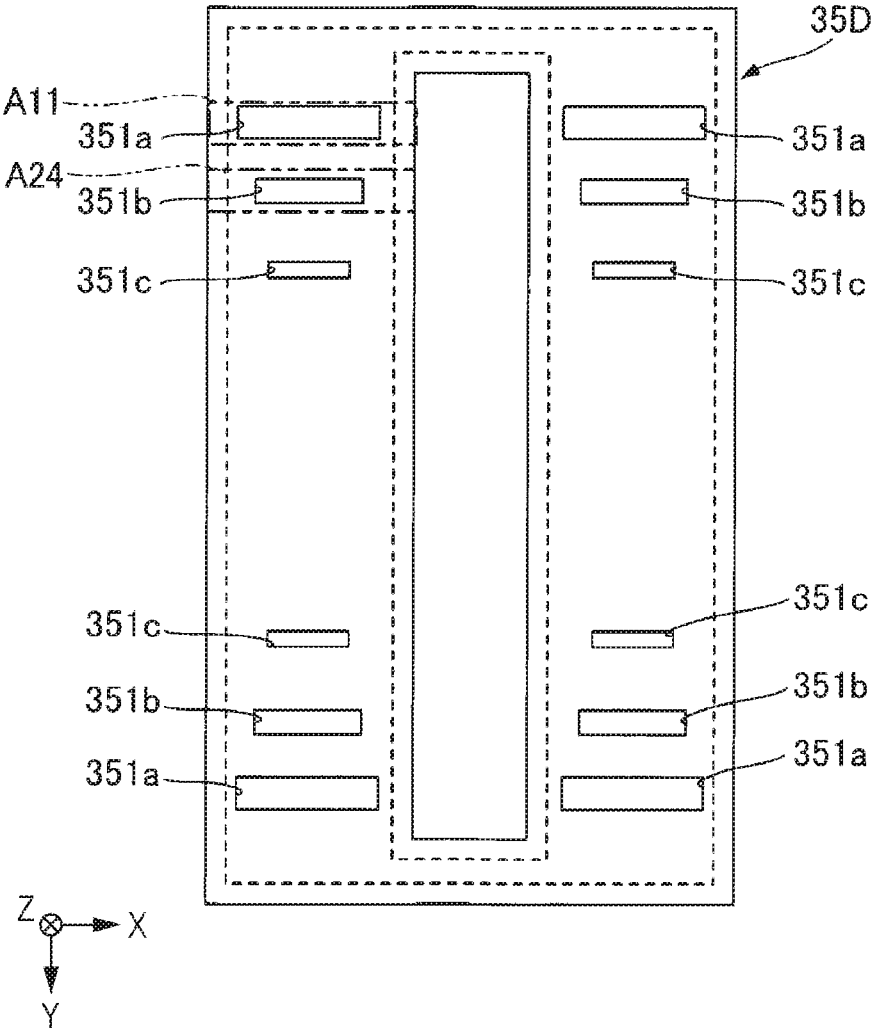
FIG. 13 is a plan view of a protection portion in a modification example.

The first portion A1 is not limited to the positions illustrated in FIGS. 5, 7, and 9. The first portion A1 may have a higher rigidity than a rigidity of the second portion A21, a rigidity of the second portion A22, or a rigidity of the second portion A23. FIG. 13 is a plan view of a protection portion 35D according to a modification example. For example, as illustrated in FIG. 13, the first portion A11 may be a portion including the first through hole 351*a*, and the second portion A24 may be a portion including the second through hole 351*b*.

Figure 14:
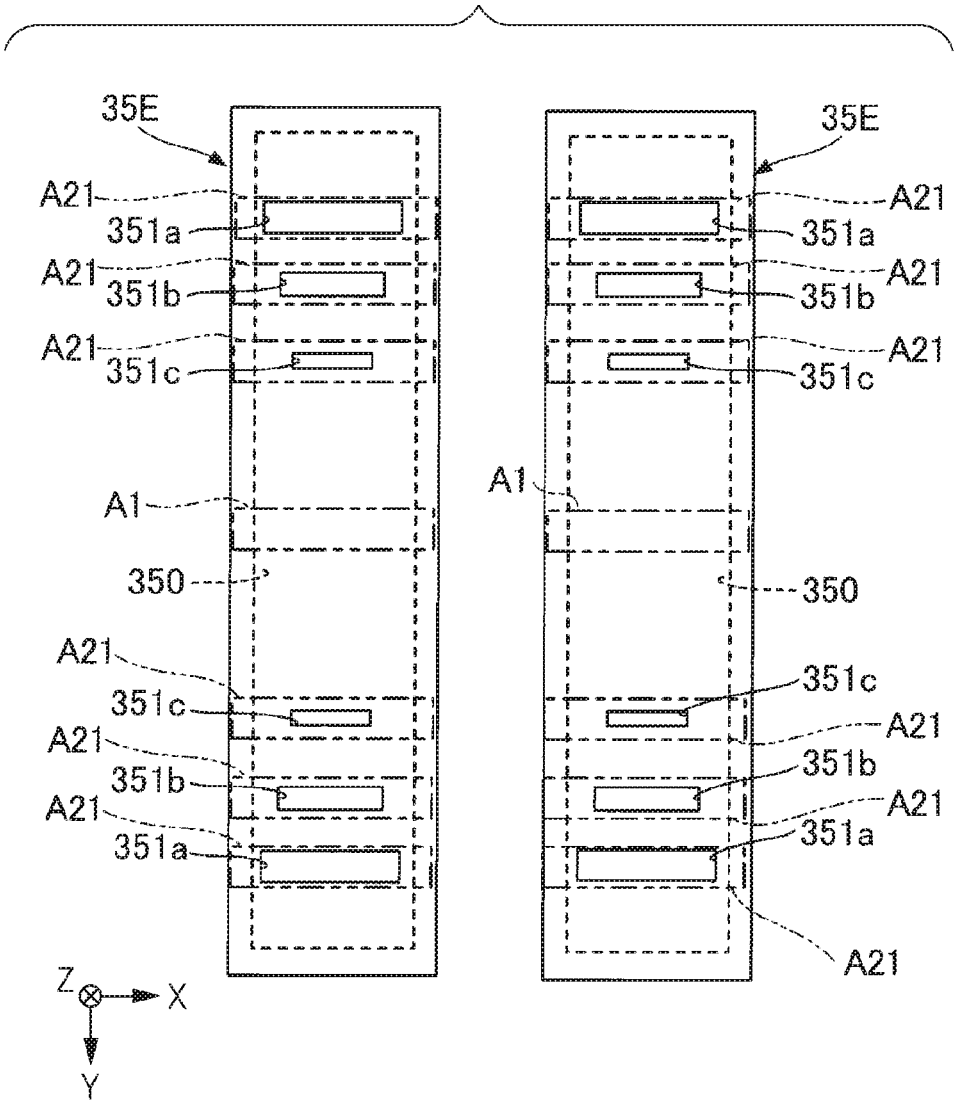
FIG. 14 is a plan view of a protection portion in a modification example.

FIG. 14 is a plan view of a protection portion 35E according to a modification example. As illustrated in FIG. 14, the protection portion 35E may be provided for each "piezoelectric element row". The protection portion 35E positioned on a side of the +X-axis corresponds to the first piezoelectric element row L1, and the protection portion 35E positioned on a side of the −X-axis corresponds to the second piezoelectric element row L2.

In the first embodiment, the vibration plate 33 is constituted with a stacked body in which the first layer 331 and the second layer 332 are stacked, but other elements may be interposed between the first layer 331 and the second layer 332. Further, the second layer 332 may be omitted from the vibration plate 33. Further, another element may be interposed between the vibration plate 33 and the pressure chamber substrate 32.

In the first embodiment, the first electrode 341 of the piezoelectric element 34 is used as an individual electrode and the second electrode 342 is used as a common electrode, but the first electrode 341 may be used as a common electrode and the second electrode 342 may be used as an individual electrode. Further, both the first electrode 341 and the second electrode 342 may be individual electrodes.

In the first embodiment, the piezoelectric element 34 is a structure in which the first electrode 341, the piezoelectric body 343, and the second electrode 342 are stacked, but other elements may be interposed between the first electrode 341 and the piezoelectric body 343 to such an extent that the function as the piezoelectric element 34 is not impaired. Similarly, other elements may be interposed between the second electrode 342 and the piezoelectric body 343.

In the first embodiment, the liquid discharge apparatus 100 of a serial method which reciprocates the transport body 242 mounted with the liquid discharge head 26 is illustrated, but it is possible that the present disclosure is also applied to a liquid discharge apparatus of a line method in which a plurality of nozzles N are distributed over the entire width of the medium 12.

The liquid discharge apparatus 100 illustrated in the first embodiment can be employed in various apparatuses such as a facsimile apparatus and a copying machine in addition to an apparatus dedicated to printing. However, the application of the liquid discharge apparatus of the present disclosure is not limited to printing. For example, a liquid discharge apparatus that discharges a solution of a color material is used as a manufacturing apparatus for forming a color filter of a display apparatus such as a liquid crystal display panel. Further, a liquid discharge apparatus that discharges a solution of a conductive material is used as a manufacturing apparatus for forming a wiring and an electrode of a wiring substrate. Further, a liquid discharge apparatus that discharges a solution of an organic substance related to a living body is used, for example, as a manufacturing apparatus for manufacturing a biochip.

In each of the embodiments, a system including two piezoelectric element rows, that is, the first piezoelectric element row L1 and the second piezoelectric element row L2 has been described, but implementation in other forms is also possible. Only one piezoelectric element row may be provided, or a plurality of rows of three or more may be provided.

What is claimed is:

1. A liquid discharge head comprising:

a pressure chamber substrate provided with a plurality of pressure chambers;

a piezoelectric element row in which a plurality of piezoelectric elements that are provided to correspond to the plurality of pressure chambers respectively and that generate a pressure for discharging a liquid are arranged in a predetermined direction;

a protection portion positioned opposite to the plurality of pressure chambers with respect to the piezoelectric element row, and forming a space common to the plurality of piezoelectric elements; and a flow path substrate in which a liquid chamber, a plurality of supply paths, and a plurality of communication flow paths are provided, wherein each of the plurality of supply paths connects between the liquid chamber and one edge of a pressure chamber of the plurality of pressure chambers in an intersecting direction, each of the communication flow paths connects between a nozzle and the other edge of the pressure chamber of the plurality of pressure chambers in the intersecting direction, the intersecting direction intersects the predetermined direction, and in regard to a first portion of the protection portion and a second portion of the protection portion having a position different from the first portion in the predetermined direction, a rigidity of the first portion is higher than a rigidity of the second portion.

2. The liquid discharge head according to claim 1, wherein the second portion has a through hole.

3. The liquid discharge head according to claim 1, wherein a groove is provided in the second portion on a side of the plurality of pressure chambers.

4. The liquid discharge head according to claim 1, wherein a thickness of the first portion is thicker than a thickness of the second portion.

5. The liquid discharge head according to claim 1, wherein a plurality of the second portions are provided at different positions in the predetermined direction.

6. The liquid discharge head according to claim 1, wherein the second portion is provided on a side of an end of the piezoelectric element row rather than on a center of the piezoelectric element row.

7. The liquid discharge head according to claim 1, wherein the piezoelectric element row is a first piezoelectric element row, the liquid discharge head further comprises a second piezoelectric element row provided at a position different from the first piezoelectric element row in an intersecting direction intersecting the predetermined direction, and the second portion is provided at a position different from a center of the protection portion in the intersecting direction.

8. A liquid discharge head comprising:

a pressure chamber substrate provided with a plurality of pressure chambers;

a piezoelectric element row in which a plurality of piezoelectric elements that are provided to correspond to the plurality of pressure chambers respectively and that generate a pressure for discharging a liquid are arranged in a predetermined direction;

a protection portion positioned opposite to the plurality of pressure chambers with respect to the piezoelectric element row, and forming a space common to the plurality of piezoelectric elements; and a flow path substrate in which a liquid chamber, a plurality of supply paths, and a plurality of communication flow paths are provided, wherein each of the plurality of supply paths connects between the liquid chamber and one edge of a pressure chamber of the plurality of pressure chambers in an intersecting direction, each of the communication flow paths connects between a nozzle and the other edge of the pressure chamber of the plurality of pressure chambers in the intersecting direction, the intersecting direction intersects the predetermined direction, and a through hole communicating with the space is provided in the protection portion.

9. A liquid discharge head comprising:

a pressure chamber substrate provided with a plurality of pressure chambers;

a piezoelectric element row in which a plurality of piezoelectric elements that are provided to correspond to the plurality of pressure chambers respectively and that generate a pressure for discharging a liquid are arranged in a predetermined direction;

a protection portion positioned opposite to the plurality of pressure chambers with respect to the piezoelectric element row, and forming a space common to the plurality of piezoelectric elements; and a flow path substrate in which a liquid chamber, a plurality of supply paths, and a plurality of communication flow paths are provided, wherein each of the plurality of supply paths connects between the liquid chamber and one edge of a pressure chamber of the plurality of pressure chambers in an intersecting direction, each of the communication flow paths connects between a nozzle and the other edge of the pressure chamber of the plurality of pressure chambers in the intersecting direction, the intersecting direction intersects the predetermined direction, and in regard to a first portion of the protection portion and a second portion of the protection portion having a position different from the first portion in the predetermined direction, a thickness of the first portion is thicker than a thickness of the second portion.

10. A liquid discharge apparatus comprising:

the liquid discharge head according to claim 1; and a control portion controlling operation of the liquid discharge head.

11. The liquid discharge head according to claim 1, wherein the first portion at least partially overlaps the plurality of piezoelectric elements.

12. The liquid discharge head according to claim 8, wherein the through hole is different from a hole that is provided for inserting a wiring substrate that connects with the plurality of piezoelectric elements.

13. The liquid discharge head according to claim 9, wherein the first portion at least partially overlaps the plurality of piezoelectric elements.

* * * * *